United States Patent [19]

Fleisher et al.

[11] 4,318,580

[45] Mar. 9, 1982

[54] HAND APPLIED ROTARY CONNECTOR

[75] Inventors: Larry D. Fleisher, Maplewood; Arne H. Mayala, Stillwater, both of Minn.

[73] Assignee: Minnesota Mining and Manufacturing Company, St. Paul, Minn.

[21] Appl. No.: 157,554

[22] Filed: Jun. 9, 1980

[51] Int. Cl.[3] ..... H01R 4/24

[52] U.S. Cl. ..... 339/98; 339/117 R; 339/274

[58] Field of Search ..... 339/95 D, 98, 99, 117 R, 339/274

[56] References Cited

U.S. PATENT DOCUMENTS

| | | | |
|---|---|---|---|
| 4,039,243 | 8/1977 | Johnson | 339/274 |
| 4,157,200 | 6/1979 | Roberts et al. | 339/98 |
| 4,163,868 | 8/1979 | Stotts | 339/98 X |
| 4,186,986 | 2/1980 | Shoemaker | 339/117 A X |

*Primary Examiner*—Eugene F. Desmond

*Attorney, Agent, or Firm*—Cruzan Alexander; Donald M. Sell; Terryl K. Qualey

[57] ABSTRACT

A rotary connector for insulated wires of various gauges comprises cylindrical supports having wire accepting passages and rotating together within a container and against both faces of a slotted plate contact element wherein each slot is defined by a deflectable and a deformable beam. Sealant is forced around the connection by movable vanes attached to the inner support member.

5 Claims, 11 Drawing Figures

HAND APPLIED ROTARY CONNECTOR

Figure 1:
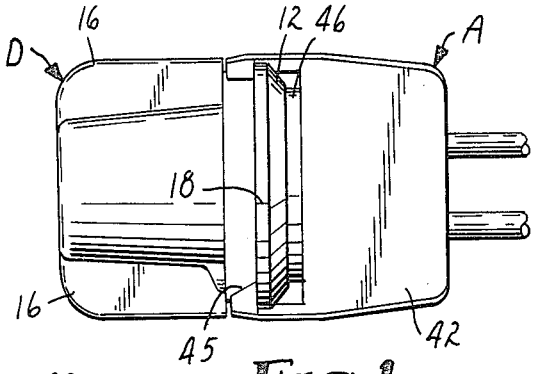

This invention relates to the connecting of insulated wires. In one aspect the invention relates to self-stripping connectors capable of accommodating insulated wires of a wide range of diameters. In another aspect the invention relates to rotary connectors having reduced torque requirements and which may be applied even to the larger guages of insulated communications wires by finger manipulation. In a further aspect the invention relates to improvements in the art of sealing the connection against moisture and other corrosive influences.

U.S. Pat. No. 4,157,208 describes a rotary self-stripping wire-connector in which the insulated wire-ends are forced into narrow slots in a metal plate. Only one of the two edges defining the wire receiving slot is deflectable for developing spring compression reserve forces. Application is limited as to guages of wire to be effectively connected, and must be accomplished with mechanical aids such as pliers or special tools.

The present invention likewise employs a slotted plate contact element providing self-stripping capabilities and resulting in spring compression reserve contact, but in addition provides for acceptance in each slot of single wires selected from a wide range of sizes and, at least for the larger wires, under surprisingly low application forces.

Figure 2:
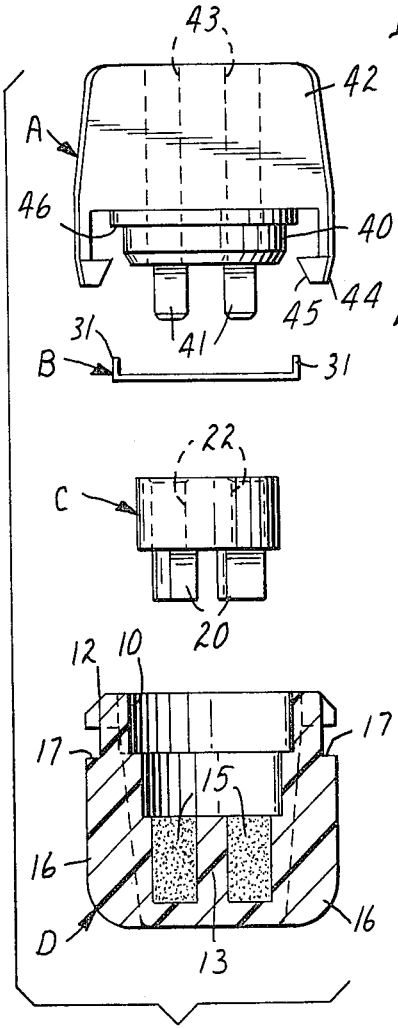
Figure 3:
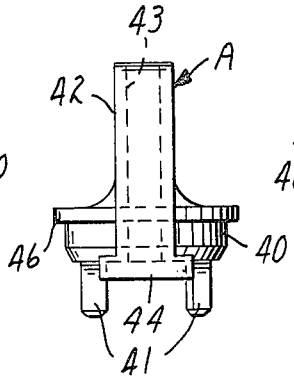
Figure 4:
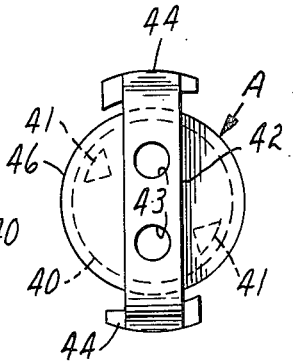
Figure 5:
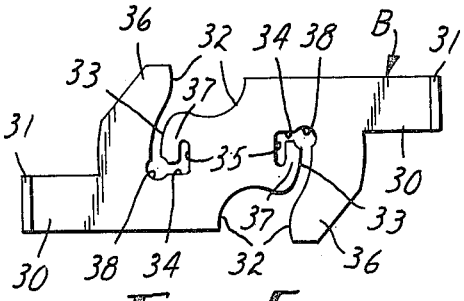
Figure 6:
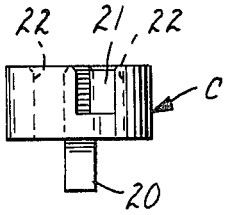
Figure 7:
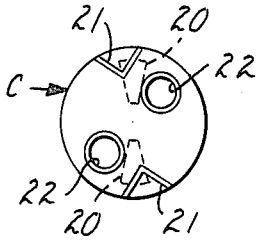
Figure 8:
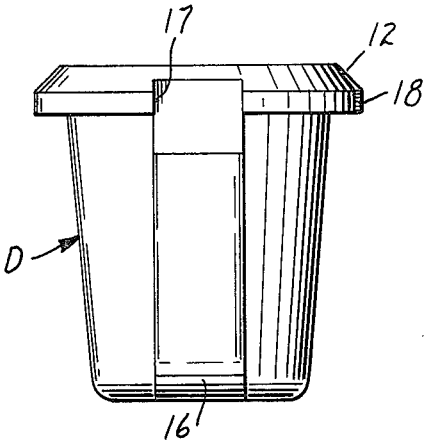
Figure 9:
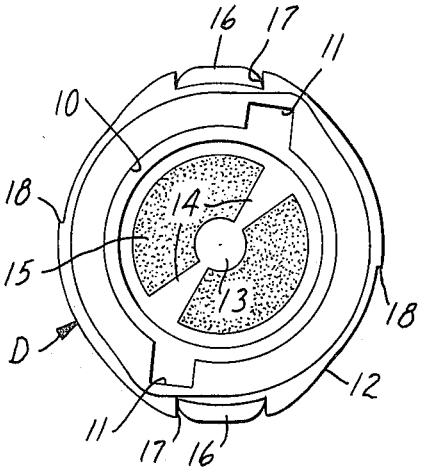
Figure 10:
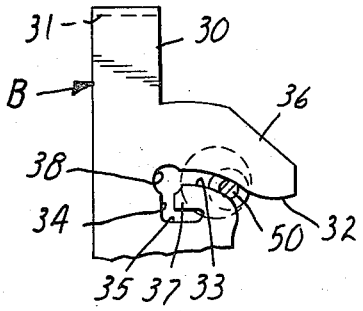
Figure 11:
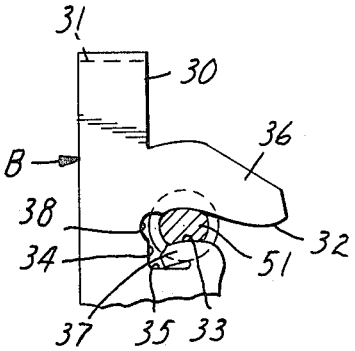

In the drawing,

FIG. 1 illustrates a connector of the invention as applied to a pair of wire ends, FIG. 2 is an exploded view showing the components of the connector in elevation, the container component being in longitudinal cross section, FIGS. 3 and 4 show the cap component A of FIG. 2 in side elevation and top plan view respectively, FIG. 5 is a bottom plan view of the contact element of FIG. 2B, FIGS. 6 and 7 are side elevation and top plan views respectively of the pump or plunger component of FIG. 2C;

FIGS. 8 and 9 are side elevation and top plan views respectively of the container component of FIG. 2, and FIGS. 10 and 11 are partial plan views illustrating the action of the contact element with wires of minimal and maximal diameters respectively.

Plug A, plunger C and container D are of insulating material, such as polypropylene, whereas contact element B is formed of conductive metal plate such for example as hard copper alloy No. 260 and may be plated, e.g. with tin.

Container D has a generally conical hollow body, the interior being in three cylindrical sections of decreasing diameter. The wall 10 of the outermost section is grooved axially and oppositely at grooves 11, these grooves extending through the rim 12. The innermost section contains a central post 13 and opposed fixed vanes 14, the remaining space being filled with sealant 15. Silicone grease is a typical viscous sealant material.

Exteriorly, container D has opposed handles 16. Rim 12 is notched at notches 17 in line with the handles and is further lightly notched, as at offsets 18, for establishing the position of the plug member prior to making a connection.

The plunger C is cylindrical and fits within the central section of the container. Opposed vanes 20 extend axially from the inner face and fit within the innermost section and against the adjacent faces of vanes 14. The exterior of the plunger is oppositely axially grooved at grooves 21. Wire passages 22 extend axially through the plunger.

Contact element B is generally rectangular in shape. Opposed longitudinal corner extensions 30 having upturned ends 31 fit within grooves 11 of container D and restrain the element from rotation within the container. The plate is slotted symmetrically from each longitudinal edge to provide a semicircular opening with edges 32, leading into a narrow arcuate slot with edges 33 which then extends longitudinally between edges 34 and transversely between edges 35, forming an outer beam 36 and an opposed inner beam 37. The corner formed between outer edges 33 and 34 is preferably enlarged to constant radius as illustrated at edge 38. When properly proportioned, the structure just illustrated produces an outer beam 36 which is deflectable and an inner beam 37 which is deformable under the force required for insertion of the larger sizes of wires for which the connector is designed, as will be further described.

The plug A includes a cylindrical portion 40 which fits within the outermost section of container D and against the contact element B. Opposed triangularly cross sectioned pegs 41 extending axially from the inner face of the cylinder bypass the longitudinal edges of the element B and fit into grooves 21 of plunger C for transmitting torque to the plunger. A handle 42 extends from the other face of the plug. Wire passages 43 extend axially through the structure and in alignment with the circular edges 32 of the element B and the passages 22 of plunger C when the connector is assembled for use. Legs 44 depending from the handle 42 fit over the rim 12 against the offsets 18 of the container D, with feet 45 extending beneath the rim 12 for holding the plug and container together. A flange 46 around the upper edge of the cylinder 40 fits snugly agains the rim 12.

Electrical connection between wire ends is accomplished by thrusting the wire ends into the passages 43 and through the passages 22, and then hand twisting the two exposed members of the connector until the legs 44 snap into the grooves 17. Both visual and tactile indication of completion of the connection is thus provided. The final position of the passages 22 and 43 with respect to the contact element is then as shown by the dotted circles in FIGS. 10 and 11.

FIG. 10 illustrates the position of a minimum diameter wire after contact has been established. The insulated wire lies along the side of the passage and the metal conductor 50 is held between the elastically deflected outer beam 36 and the supporting base of the inner beam 37.

FIG. 11 illustrates a contact with a wire of maximum diameter. The insulated wire substantially fills the passage, the conductor 51 therefore being forced farther along the arcuate slot. The outer beam 36 is again resiliently deflected; the inner beam, being significantly narrower, is deformed, widening the slot and decreasing the force required for insertion of the wire.

One specific embodiment of the rotary connector here described is capable of accepting communications wires of from No. 26 to No. 19 guage. The diameter of the wire accepting passages 43,22 is 2.0 mm. The width of the arcuate slot is 0.305 mm. The minimum width of the beam 36 at its base is 1.33 mm. The minimum width of the beam 37 is one third of that distance, i.e. 0.44 mm.

The plate is 0.406 or 0.457 mm No. 260 full hard cartridge brass.

Surprisingly, connectors of this invention not only produce fully effective connections with wires covering a wide range of diameters, but do so under the application of very moderate twisting forces such as may be applied by hand without fatigue during repetitive operations. As an illustration, connectors made as just described have been compared with otherwise identical connectors in which the transverse component of the slot was omitted, thereby avoiding deformation of an inner beam. Two wires of identical guage were connected in each instance.

TABLE 1

| Torque required for connection, inch-ounces. | | |
|---|---|---|
| Wire Guage | Fixed Beam | Deformable Beam |
| 19 | 80–96 | 44–48 |
| 22 | 48 | 24 |
| 24 | 18–20 | 16 |
| 26 | 10–12 | 8–10 |

The hand twisting motion applied to make the electrical connection acts also to force the sealant out of the innermost section of the container D into the passages 22 and 43 and around the contact areas. This result is attained as each of vanes 20 is forced around the channel between post 13 and the wall of the section, away from contact with one of the fixed vanes 14 and toward the other of said fixed vanes.

What is claimed is as follows:

1. A rotary electrical connector comprising: (1) an insulating container having a laterally notched rim and opposed radially extending handles, the open interior being in three cylindrical sections of decreasing diameter, the wall of the outermost section being oppositely grooved to provide first axial grooves extending through said rim, the innermost section containing a central post and two oppositely disposed fixed vanes connecting post and wall; (2) a doubly perforate insulting plunger fitting said central section, having two oppositely disposed vanes extending axially from one face for fitting within said innermost section alongside said fixed vanes, and grooved to provide oppositely disposed second axial grooves; (3) a generally rectangular flat plate contact element fitting within said outermost section, having opposed longitudinal corner extensions fitting within said first axial grooves, slotted symmetrically from each longitudinal edge to provide a semicircular opening leading into a narrow arcuate slot which is extended longitudinally and thence transversely of said plate and forming a deflectable outer beam and an opposed deformable inner beam; and (4) an insulating doubly perforate plug fitting within said outermost section and against said rim, having inwardly extending pegs fitting within said second axial grooves and having an outwardly extending handle member having oppositely disposed retaining legs; the perforations in said plunger and plug being axially disposed and in alignment with said semicircular openings for entry of wire ends, and said plunger and plug being rotatable with respect to said container and plate for forcing said wire ends into said arcuate slots and into electrical contact with the edges defining said slots.

2. Connector of claim 1 wherein said innermost section containing said post and vanes is filled with a viscous sealant.

3. A rotary electrical connector comprising:

a container having in an innermost section a central post and two oppositely disposed vanes connecting said post and to the wall of said container wall; an insulating plunger rotatably fitting within said container and with an inner face against said post and vanes, having two oppositely disposed vanes extending axially from said inner face and fitting against first faces of said container vanes and between said post and wall, and having two open axial passages for introduction of wire ends; and a viscous sealant filling said innermost section around said post and vanes, said sealant being forced out of said section and into said passages when said plunger is rotated to force said plunger vanes toward the opposite faces of said container vanes.

4. A rotary electrical connector comprising:

an insulating container means; a generally rectangular flat plate doubly slotted contact means fixedly disposed within said container means in a plane perpendicular to the longitudinal axis thereof; and insulating doubly perforate wire support means rotatably fitting within said continer means and against both flat faces of said contact means; and wherein said contact means is slotted symmetrically from each longitudinal edge to provide a semicircular opening leading into a narrow arcuate slot which is extended longitudinally and thence transversely of said plate to form a deflectable outer beam and an opposed deformable inner beam; the perforations of said support means being axial and in alignment with said semicircular openings for permitting the insertion of wire ends which are to be connected.

5. A rotary electrical connector comprising:

a generally rectangular flat plate contact element symmetrically slotted from each longitudinal edge to provide a semicircular opening leading into a narrow arcuate slot which is extended longitudinally and thence transversely of the plate to form a deflectable outer beam and an opposed deformable inner beam; first support means for fixedly supporting said contact element; and second support means in contact with both faces of said contact element, containing wire receiving passages perpendicular to said element and in alignment with each said semicircular opening, and rotatable with respect to said first support means for forcing wires supported in said passages into said arcuate slots.

* * * * *